US007085513B2

(12) United States Patent
Kim et al.

(10) Patent No.: US 7,085,513 B2
(45) Date of Patent: Aug. 1, 2006

(54) MULTI-FUNCTION OFFICE APPARATUS

(75) Inventors: Young-min Kim, Suwon-si (KR); Byung-sun Ahn, Suwon-si (KR); Sang-cheol Park, Suwon-si (KR)

(73) Assignee: Samsung Electronics Co. Ltd., Suwon-si (KR)

( * ) Notice: Subject to any disclaimer, the term of this patent is extended or adjusted under 35 U.S.C. 154(b) by 126 days.

(21) Appl. No.: 10/937,410

(22) Filed: Sep. 10, 2004

(65) Prior Publication Data

US 2005/0105933 A1 May 19, 2005

(30) Foreign Application Priority Data

Nov. 18, 2003 (KR) ..... 10-2003-0081570

(51) Int. Cl.
*G03G 21/00* (2006.01)
*G03G 15/00* (2006.01)

(52) U.S. Cl. ..... 399/98; 399/107; 399/380; 399/405

(58) Field of Classification Search ..... 399/98, 399/107, 124, 377, 379, 380, 405
See application file for complete search history.

(56) References Cited

U.S. PATENT DOCUMENTS 5,881,351 A * 3/1999 Shimotoso et al. ..... 399/377
5,913,095 A * 6/1999 Takashima et al. ..... 399/405 X
6,522,862 B1 * 2/2003 Koshimizu et al. ..... 399/405

FOREIGN PATENT DOCUMENTS

| | | |
|---|---|---|
| JP | P05-134502 | 5/1993 |
| JP | P05-134504 | 5/1993 |
| JP | P06-230621 | 8/1994 |
| JP | 08-195867 | 7/1996 |
| JP | 09-185198 | 7/1997 |
| JP | 2003-073024 | 3/2003 |

OTHER PUBLICATIONS

Korean Intellectual Property Office Action dated Jul. 28, 2005 for Korean Patent Application No. 2003-81570 filed Nov. 18, 2003.

* cited by examiner

*Primary Examiner*—Sandra L. Brase
(74) *Attorney, Agent, or Firm*—Roylance, Abrams, Berdo & Goodman, LLP

(57) ABSTRACT

An improved multi-function office machine having a paper-discharging space cover at an opening of a paper-discharging space, to prevent inflow of foreign substances into the multi-function office machine though the paper-discharging space. The multi-function office machine comprises a main body, a flat bed disposed at an upper portion of the main body to set a document, a flat bed cover with one end hinged to the main body to open and close the upper surface of the flat bed, a paper-discharging space disposed at a rear side of the main body to receive a printed paper, and having an opening at a top, and a paper-discharging space cover hinged to the rear side of the main body to open and close the opening.

18 Claims, 6 Drawing Sheets

MULTI-FUNCTION OFFICE APPARATUS

CROSS-REFERENCE TO RELATED APPLICATIONS

This application claims the benefit of Korean Application No. 2003-81570, filed Nov. 18, 2003, in the Korean Intellectual Property Office, the disclosure of which is incorporated herein by reference.

BACKGROUND OF THE INVENTION

1. Field of the Invention

The present invention relates to an image forming apparatus. More particularly, the present invention relates to a multi-function office machine capable of performing functions of a printer, a scanner, a facsimile, a photocopier and such apparatus in an integrated manner.

2. Description of the Related Art

Generally, a multi-function office machine can scan and convert a document to an image data like a scanner, transmit the data to another device through a communication circuit like a facsimile, and print out an inputted data like a printer. The multi-function office machine includes a scanning unit and a printing unit so as to perform any function of the scanner, a photocopier, the printer, and the facsimile as desired.

FIG. 1 shows an example of an electrophotographic multi-function office machine.

General electrophotographic multi-function office machines 1 comprise a paper-supplying unit 10, a paper-transferring unit 20, a developing unit 30, a fusing unit 40, a paper-discharging unit 50, a paper-discharging space 60, and a scanning unit 70. At an upper portion of the scanning unit 70, a flat bed 71 is formed to set a document to be scanned. At an upper portion of the multi-function office machine 1, a flat bed cover 72 is hinged to open and close the flat bed 71.

The paper-discharging space 60 is disposed at a rear side of the multi-function office machine 1, being open at a top. A paper is received in the paper-discharging space 60 so that a side to be printed faces the front. In addition, a guide board 61 is mounted to slide up and down at a rear wall of the paper-discharging space 60 in order to support the received paper.

When the above-structured multi-function office machine 1 operates as a printer or a photocopier, an image inputted from the flat bed 71 or an external device is processed in the same manner as in the conventional electrophotographic image forming apparatus. The paper supplied from the paper-supplying unit 10 is transferred from the paper-transferring unit 20 which comprises a plurality of rollers to the developing unit 30. Thus, a toner image is formed on the paper, and fused on the paper by heat and pressure of the fusing unit 40. The paper on which the image is fused is received into the paper-discharging space 60 through the paper-discharging unit 50 which comprises a plurality of paper-discharging rollers. The guide board 61 extended upward supports the paper.

However, since the upper portion of the paper-discharging space 60 is always open, as shown in FIG. 1, foreign substances such as a dust can flow into the multi-function office machine 1, which may cause malfunction of the machine. Furthermore, it is inconvenient that the guide board 61 has to be extended to a guiding position every time to support the received paper.

SUMMARY OF THE INVENTION

The present invention has been developed to solve at least the above problems and/or disadvantages and to provide at least the advantages described below. Accordingly, an aspect of the present invention is to provide a multi-function office machine which can prevent foreign substances from flowing into the multi-function office machine through a paper-discharging space, and has an improved structure for a convenient operation.

In order to achieve the above-described aspects of the present invention, there is provided a multi-function office machine comprising a main body, a flat bed disposed at an upper portion of the main body to set a document, a flat bed cover with one side hinged to the main body to open and close the upper surface of the flat bed, a paper-discharging space disposed at a rear wall of the multi-function office machine to receive a printed paper, and having an opening at a top, and a paper-discharging space cover having an end hinged to an upper portion of the paper-discharging space, and the other end contacted with an upper portion of the flat bed cover so as to open and close the opening in relation to movement of the flat bed cover.

In a preferred embodiment of the present invention, the paper-discharging space comprises a paper-discharging space cover hinged at the rear wall protruded upward with respect to the main body of the multi-function office machine.

The paper-discharging space cover has a rounded end which contacts the flat bed cover, or has at least one roller.

Furthermore, in the preferred embodiment, the paper-discharging space is open at approximately 95° to 135°.

BRIEF DESCRIPTION OF THE DRAWINGS

The above aspect and other features of the present invention will become more apparent by describing in detail an embodiment thereof with reference to the attached drawings.

DETAILED DESCRIPTION OF THE EXEMPLARY EMBODIMENTS

Hereinafter, embodiments of a multi-function office machine according to the present invention will be described in detail with reference to the accompanying drawings.

Figure 1:
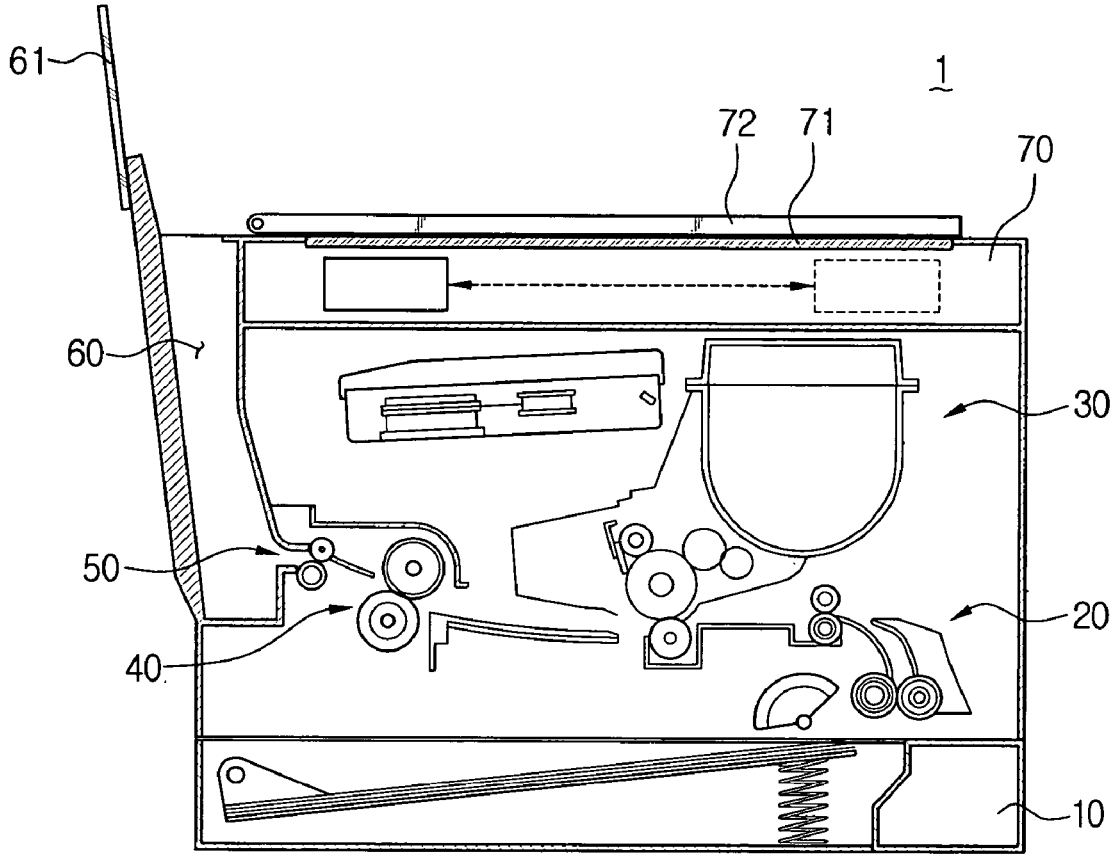
FIG. 1 (PRIOR ART)
FIG. 1 is a view of a general multi-function office machine.
Figure 2A:
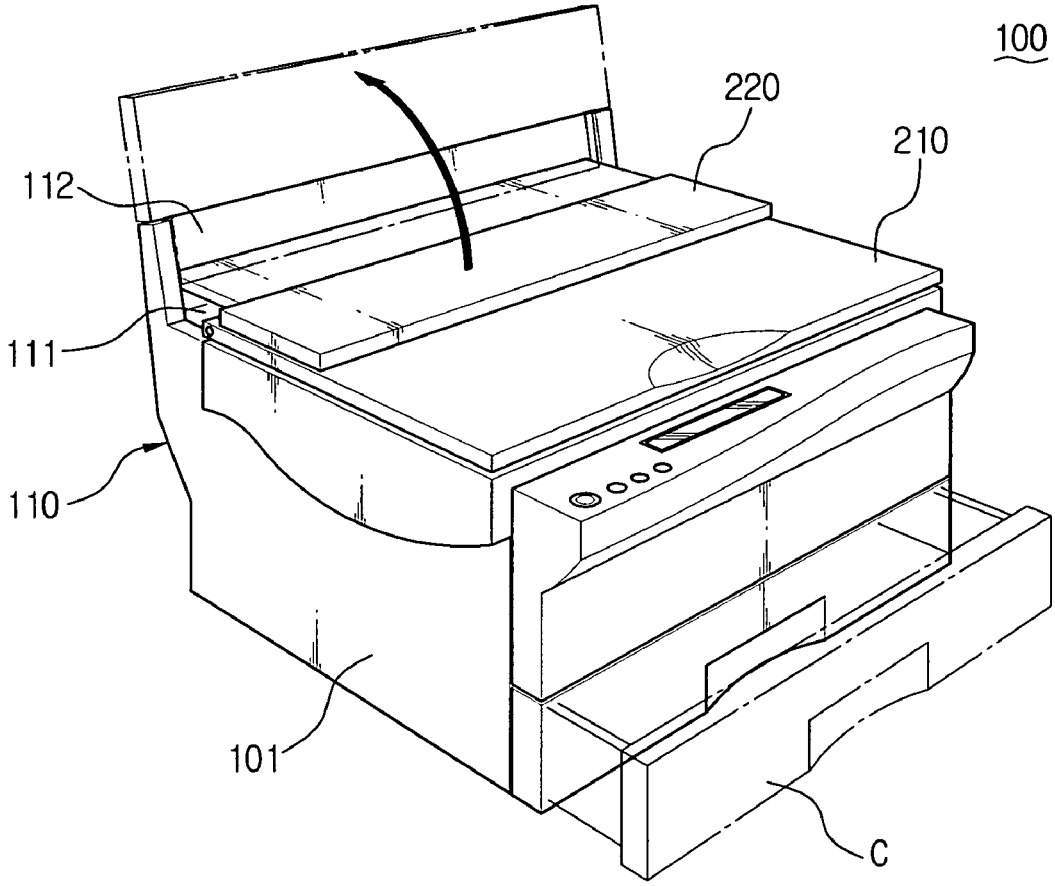
FIGS. 2A and 2B are perspective views showing the exterior of a multi-function office machine according to an embodiment of the present invention.
Figure 2B:
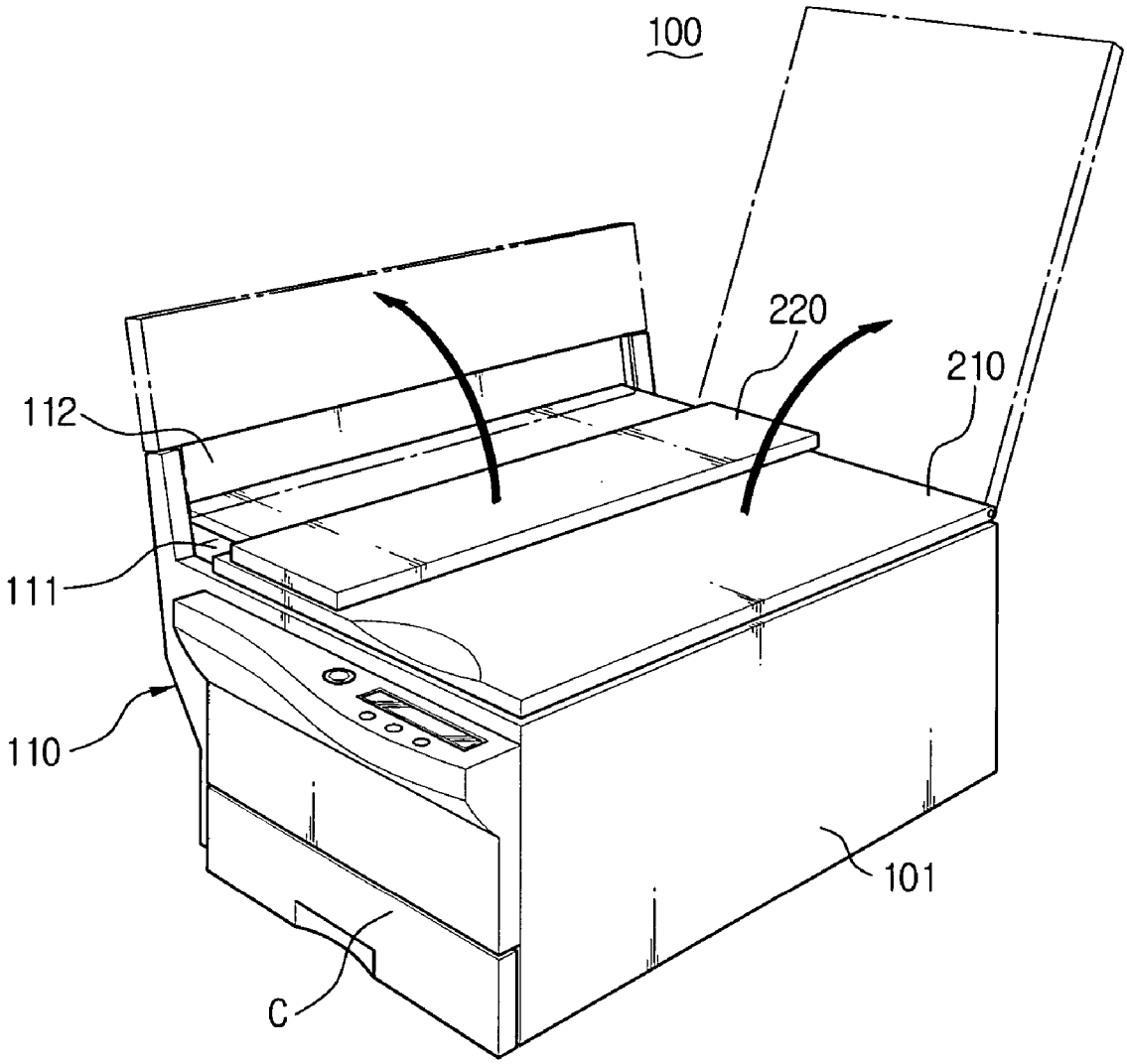

FIG. 2A is a perspective view of a multi-function office machine according to the present invention. A main body 101 comprises a paper-supplying unit C being open to the front to receive a paper, and a flat bed cover 210 hinged at an upper portion of the main body 101 to open and close a flat bed F (see FIG. 3) which sets a document. At a rear side of the main body 101, a paper-discharging space 110 is disposed to receive a printed paper. The paper-discharging space 110 comprises an opening 111 and a rear wall 112. The opening 111 allows the printed paper to pass therethrough, and the rear wall 112 supports the printed paper. The opening 111 is opened and closed by a paper-discharging space cover 220. One end of the paper-discharging space cover 220 is hinged with the rear wall 112, and the other end contacts the flat bed cover 210. As shown in FIG. 2B, the paper-discharging space 110 may be disposed at a lateral side of the main body 101 of the multi-function office machine 100.

Figure 3:
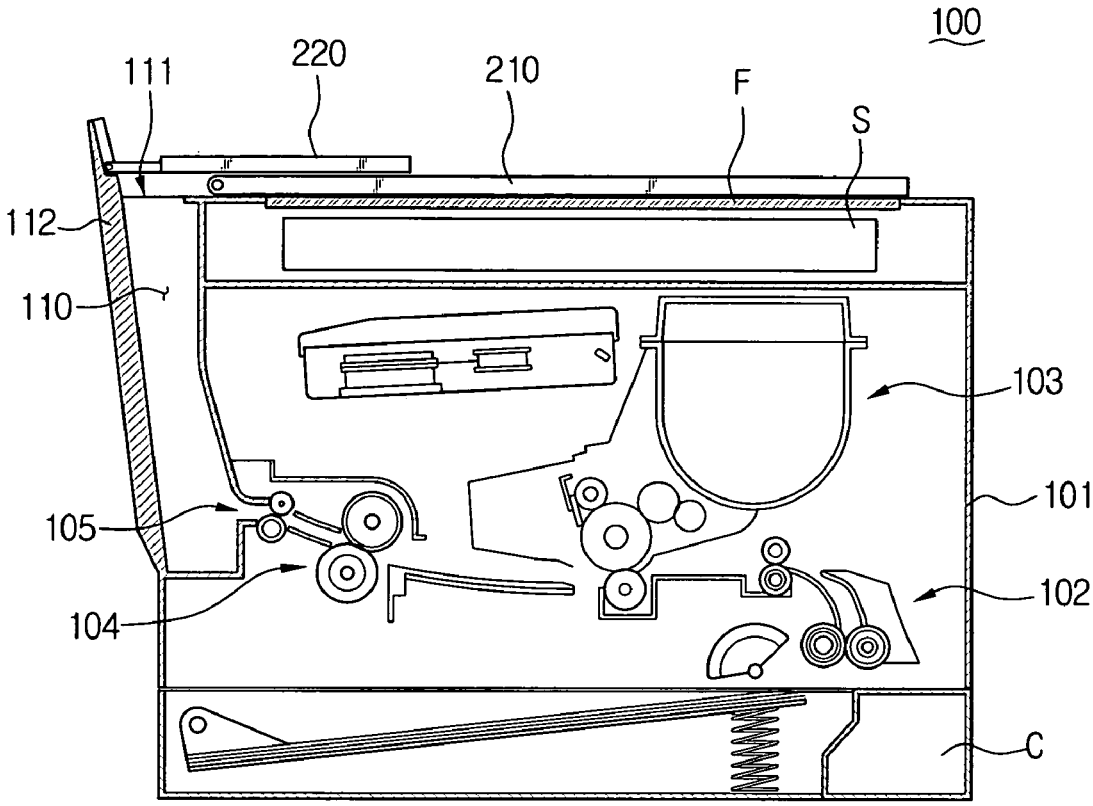
FIG. 3 is a view of the multi-function office machine according to an embodiment of the present invention.

FIG. 3 schematically shows inside of the multi-function office machine 100 of the above structure according to the present invention. As shown in FIG. 3, the multi-function office machine 100 comprises a paper-supplying unit C, a paper-transferring unit 102, a developing unit 103, a fusing unit 104, a paper-discharging unit 105, the paper-discharging space 110, and a scanning unit S. At an upper portion of the scanning unit S, the flat bed F is disposed to set the document to be scanned. In order the open and close the flat bed F, a flat bed cover 210 is hinged at one side of the upper portion of the multi-function office machine 100. A printing process is the same as in general electrophographic image forming apparatus, and therefore, it will not be described in detail.

Figure 4:
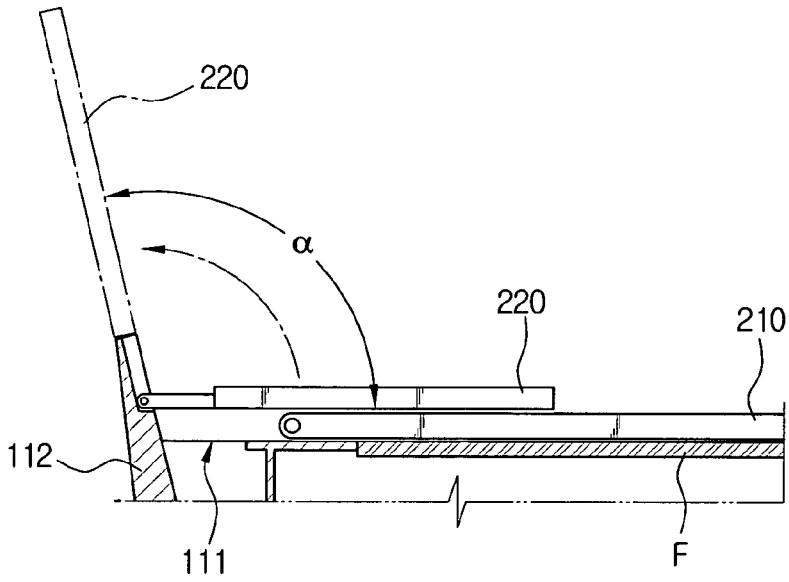
FIG. 4 is an enlarged view of the main parts of FIG. 3 showing a paper-discharging space cover which pivots independently.

The paper-discharging space cover 220 may be independently opened by a user, as shown FIG. 4. Alternatively, the paper-discharging space cover 220 may be opened in relation to pivotal movement of the flat bed cover 210.

Figure 6:
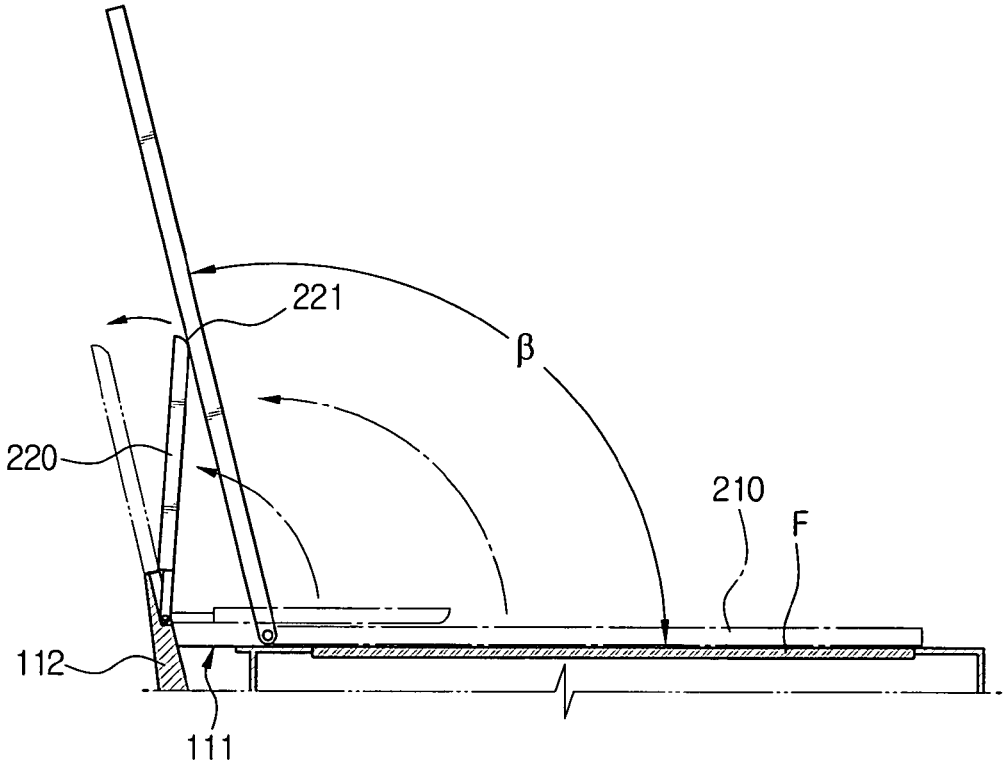
FIG. 6 shows the operation of the paper-discharging space cover having a rounded end according to one embodiment of the present invention.

As shown in FIG. 6, the paper-discharging space cover 220 may have a rounded end 221 to reduce friction between the end 221 and the flat bed cover 210. Alternatively, the paper-discharging space cover 220 may have one or more roller 222 at the end for the same purpose.

Hereinafter, the operation of the multi-function office machine 100 according to the present invention will be described with reference to the annexed drawings.

The multi-function office machine 100 according to the present invention can be used as a scanner, a photocopier, a printer, and a facsimile as the user demands. When the multi-function office machine 100 is used as the printer, the opening 111 at the upper portion of the paper-discharging space 110 should be opened so that the printed paper is received in the paper-discharging space 110. For this, as shown in FIG. 2 and FIG. 4, the user independently lifts up the paper-discharging space cover 220. Then, the paper-discharging space cover 220 is pivoted to a predetermined position of the rear wall 112, and the opening 111 is accordingly opened. The open paper-discharging space cover 220 overlaps the rear wall 112, extending the rear wall 112 upward, as shown in FIG. 4. Therefore, passing through the paper-discharging unit 105, and contacting the rear wall 112, the printed paper comes to have its leading end head upward. Accordingly, the paper which passed through the opening 111 is transmitted along the rear wall 112 and the paper-discharging space cover 220, and is received in the paper-discharging space 110 with the printed side facing the front.

Referring to FIG. 4, a part of the paper which passed through the opening 111 is prevented from bending caused by its own weight since the paper-discharging space cover 220 extends the rear wall 112 upward. Therefore, the paper does not fall over the rear portion of the multi-function office machine 100.

An opening angle $\alpha$ of the paper-discharging space cover 220 is substantially 95° to 135°. If the angle $\alpha$ is less than 95°, the received paper is likely to incline to the front of the multi-function office machine 100. If the angle $\alpha$ is greater than 135°, the whole length of the multi-function office machine 100 increases to cause inconvenience in use.

Figure 5:
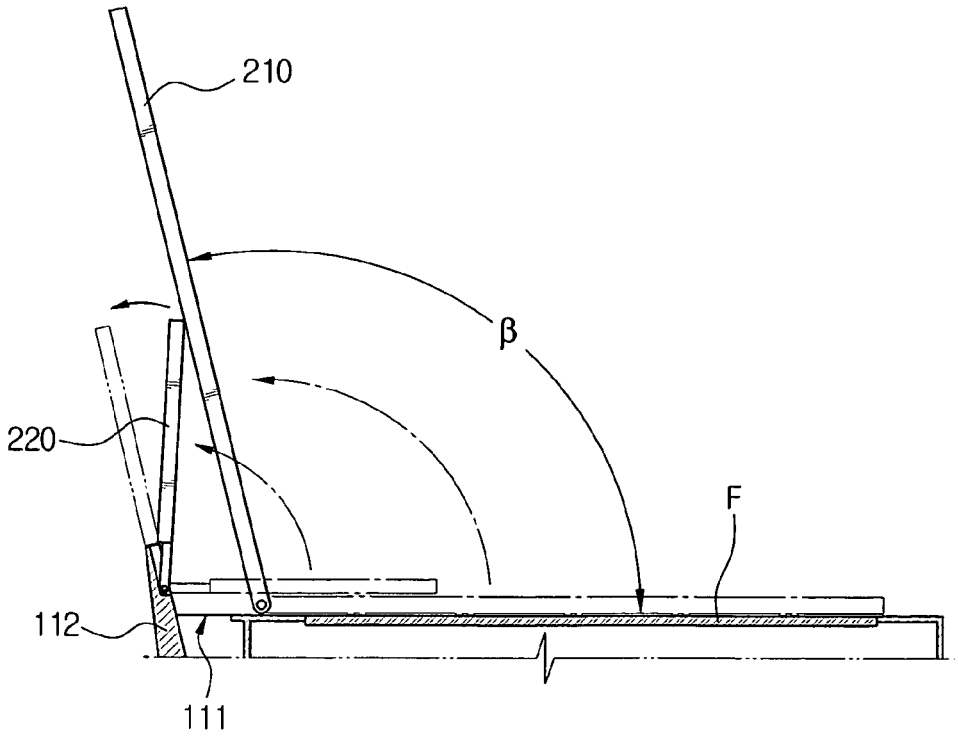
FIG. 5 is an enlarged view of the main parts of FIG. 3 showing a paper-discharging space cover which pivots in relation to pivotal movement of a flat bed cover.

On the other hand, when the multi-function office machine 100 is used as the scanner or the photocopier, the flat bed cover 210 should be opened so that an upper surface of the flat bed F is exposed to the document. In general, the document is set to have a side to be scanned face the flat bed F, such that the scanning unit S can read the document. In this state, since the paper-discharging space cover 220 is overlapped with the flat bed cover 210, as shown in FIG. 5, when the flat bed cover 210 is opened, the paper-discharging space cover 220 pivots in relation to the pivotal movement of the flat bed cover 210. The pivoting angle $\beta$ of the flat bed cover 210 is substantially at least 90°. When the pivoting angle $\beta$ is not less than 90°, an inertia force by the pivotal movement of the flat bed cover 210 is transmitted to the paper-discharging space cover 220. Therefore, only by opening the flat bed cover 210, the user can pivot the paper-discharging space cover 220 together.

Figure 7:
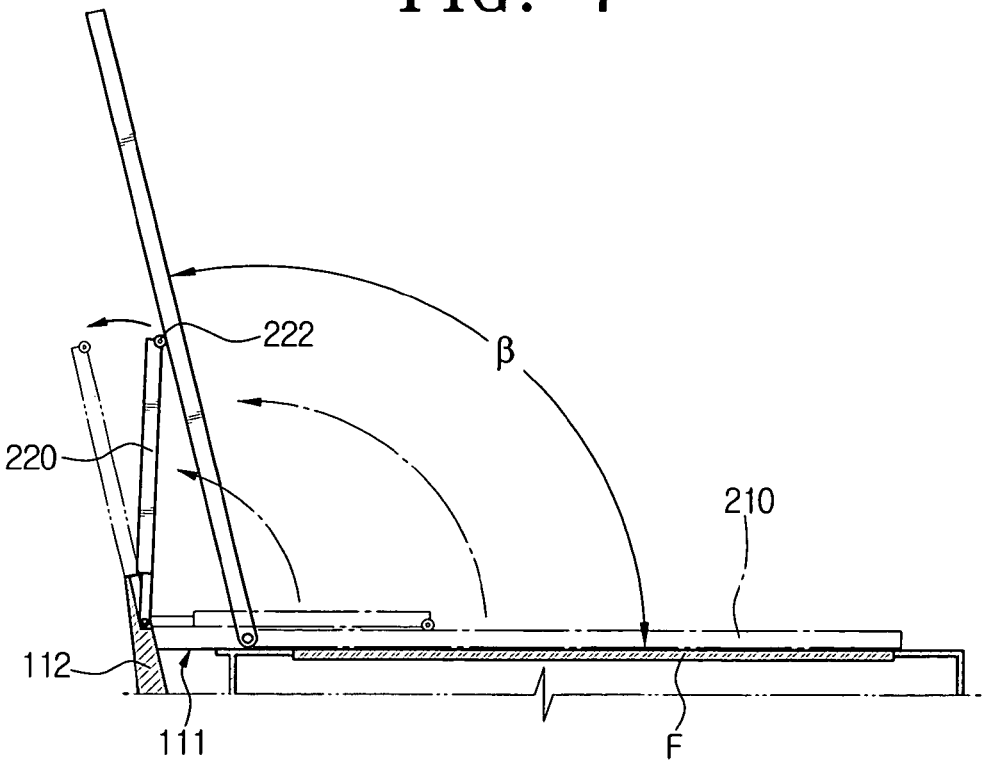
FIG. 7 shows the operation of the paper-discharging space cover comprising a roller at an end according to another embodiment of the present invention.

The friction force at the end of the paper-discharging space cover 220 by a contact with the flat bed cover 210, may interfere the opening operation of the flat bed cover 210. In order to reduce the friction force, the paper-discharging space cover 220 may have a rounded end 221, as shown in FIG. 6. Alternatively, the paper-discharging space cover 220 may comprise a roller 222 idly rotating at the end, as shown in FIG. 7. By slipping at the rounded end 221, or by an idle rotation of the roller 222, when the flat bed cover 210 pivots, the paper-discharging space cover 220 contacting the flat bed cover 210 does not interfere the pivotal movement of the flat bed cover 210. Accordingly, the paper-discharging space cover 220 is pivoted by a maximum pivoting angle by opening of the flat bed cover 210. Therefore, the paper-discharging space cover 220 opens the opening 111, and supports the paper with the rear wall 112.

After the operation of the multi-function office machine 100, in order to prevent a foreign substance such as a dust flowing into the paper-discharging space 110, the user returns the paper-discharging space cover 220 to an initial position shown in FIG. 3 in reverse order by pivoting the paper-discharging space cover 220 counterclockwise in FIGS. 4 through 7.

As can be appreciated from the above description of the multi-function office machine 100, due to presence of the paper-discharging space cover 220 on the opening 111, foreign substances such a as dust does not flow into the multi-function office machine 100 through the paper-discharging space 110.

In addition, since the paper-discharging space cover 220 also functions as a guide board of the prior art for supporting the received paper, the user does not have to set the guide board to a paper-supporting position every time in using the multi-function office machine 100.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A multi-function office machine capable of functioning as at least two of a scanner, a photocopier, a printer, and a facsimile as necessary, comprising:

a main body;

a flat bed disposed at an upper portion of the main body to set a document;

a flat bed cover with one end hinged to the main body to open and close the upper surface of the flat bed;

a paper-discharging space disposed at one side of the main body to receive a printed paper, and having an opening at a top; and a paper-discharging space cover hinged to one side of the main body to open and close the opening.

2. The multi-function office machine of claim 1, wherein the paper-discharging space has a paper-discharging space cover hinged to a wall protruded upward with respect to the main body.

3. The multi-function office machine of claim 1, wherein the paper-discharging space cover contacts an upper portion of the flat bed cover to open the opening in relation to an opening operation of the flat bed cover.

4. The multi-function office machine of claim 1, wherein the paper-discharging space cover has a rounded end contacting the flat bed cover.

5. The multi-function office machine of claim 1, wherein the paper-discharging space cover has at least one roller at the end contacting the flat bed cover.

6. The multi-function office machine of claim 1, wherein the paper-discharging space cover has an opening angle of approximately 95° to 135°.

7. The multi-function office machine of claim 1, wherein the paper-discharging space disposed at a rear side of the main body.

8. The multi-function office machine of claim 1, wherein the paper-discharging space disposed at a lateral side of the main body.

9. A method for operating a multi-function office machine comprised of a main body, and capable of functioning as at least two of a scanner, photocopier, printer, and facsimile machine as necessary, to substantially prevent the in-flow of foreign substances through a paper-discharging space, comprising:

covering a flat bed disposed at an upper portion of the main body of the multi-function office machine with a flat bed cover with one end hinged to the main body to open and close the upper surface of the flat bed, the multi-function office machine having a paper-discharging space disposed at a rear side of the main body to receive a printed paper, and having an opening at a top; and selectively pivoting a paper-discharging space cover hingedly attached to a rear side of the main body to engage the flat bed cover at its distal end to close the opening of the paper-discharging space, such that the inflow of foreign substances is substantially prevented through the opening into the paper-discharging space.

10. The method according to claim 9, further comprising:

setting a document into a flat bed of the multi-function office machine.

11. The method according to claim 9, further comprising:

receiving printed paper from paper-discharging space of the multi-function office machine.

12. The multi-function office machine according to claim 9, wherein the paper-discharging space has the paper-discharging space cover hinged to a rear wall protruding upward with respect to the main body.

13. The multi-function office machine according to claim 9, wherein the paper-discharging space cover contacts an upper portion of the flat bed cover to open the opening in relation to an opening operation of the flat bed cover.

14. The multi-function office machine according to claim 9, wherein the paper-discharging space cover has a rounded end contacting the flat bed cover.

15. The multi-function office machine according to claim 9, wherein the paper-discharging space cover has at least one roller at the end contacting the flat bed cover.

16. The multi-function office machine according to claim 9, wherein the paper-discharging space cover has an opening angle of or about 95° to at or about 135°.

17. The multi-function office machine of claim 9, wherein the paper-discharging space disposed at a rear side of the main body.

18. The multi-function office machine of claim 9, wherein the paper-discharging space disposed at a lateral side of the main body.

* * * * *